US008494379B2

(12) United States Patent
Kim

(10) Patent No.: US 8,494,379 B2
(45) Date of Patent: Jul. 23, 2013

(54) IMAGE FORMING APPARATUS WITH TONER CARTRIDGE AUTHENTICATION

(75) Inventor: Min Gyu Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/067,030

(22) Filed: May 3, 2011

(65) Prior Publication Data

US 2011/0211850 A1 Sep. 1, 2011

Related U.S. Application Data

(63) Continuation of application No. 12/170,737, filed on Jul. 10, 2008, now Pat. No. 7,962,051.

(30) Foreign Application Priority Data

Jan. 9, 2008 (KR) ..... 10-2008-0002561

(51) Int. Cl.
*G03G 15/08* (2006.01)

(52) U.S. Cl.
USPC ..... 399/12; 399/262

(58) Field of Classification Search
USPC ..... 399/12, 13, 262
See application file for complete search history.

(56) References Cited

U.S. PATENT DOCUMENTS

| | | | | |
|---|---|---|---|---|
| 5,363,134 | A * | 11/1994 | Barbehenn et al. | 347/49 |
| 5,504,507 | A * | 4/1996 | Watrobski et al. | 347/19 |
| 6,830,391 | B2 * | 12/2004 | Clayvon et al. | 400/88 |
| 6,922,534 | B2 | 7/2005 | Goto et al. | |
| 7,198,348 | B2 * | 4/2007 | Hu | 347/19 |
| 2003/0228163 | A1 | 12/2003 | Yokoi et al. | |
| 2005/0244169 | A1 * | 11/2005 | Ono | 399/12 |
| 2005/0249510 | A1 * | 11/2005 | Ito et al. | 399/12 |
| 2007/0071458 | A1 | 3/2007 | Tanaka et al. | |
| 2007/0154228 | A1 | 7/2007 | Chan | |
| 2008/0273883 | A1 | 11/2008 | Kim et al. | |

FOREIGN PATENT DOCUMENTS

| | | |
|---|---|---|
| EP | 1 767 369 A2 | 3/2007 |
| JP | 2001-345554 | 12/2001 |
| JP | 2001-356654 | 12/2001 |
| JP | 2007-122011 | 12/2001 |

OTHER PUBLICATIONS

Chinese Office Action issued Jun. 11, 2010 in corresponding Chinese Patent Application 200810161182.5.
Office Action dated Oct. 15, 2010 in parent U.S. Appl. No. 12/170,737.
Notice of Allowance date Jul. 6, 2010 in parent U.S. Appl. No. 12/170,737.
Notice of Allowance dated Feb. 3, 2011 in parent U.S. Appl. No. 12/170,737.
Korean Office Action dated Apr. 24, 2012 issued in corresponding Korean Patent Application No. 10-2008-0002561.
Japanese Office Action dated Oct. 2, 2012 issued in corresponding Japanese Patent Application No. 10-2008-204270.

* cited by examiner

*Primary Examiner* — G. M. Hyder
(74) *Attorney, Agent, or Firm* — Staas & Halsey LLP

(57) ABSTRACT

An image forming apparatus, the image forming apparatus including: a toner cartridge including a memory to provide first authentication information, and an authentication key circuit to provide a second authentication information; and a controller to authenticate the toner cartridge when the first authentication information and the second authentication information are identical. Furthermore, the controller intentionally destroys the first authentication information or the second authentication information when there is no toner in the toner cartridge. Accordingly, it is possible to prevent an unauthorized use of the toner cartridge, and thus to perform an ideal print operation.

10 Claims, 6 Drawing Sheets

FIG. 4

| | AUTHENTICATION KEY CIRCUIT | CRUM |
|---|---|---|
| P1 | 1 | 1 |
| P2 | 0 | 0 |
| P3 | 0 | 0 |
| P4 | 1 | 1 |
| P5 | 1 | 1 |

IMAGE FORMING APPARATUS WITH TONER CARTRIDGE AUTHENTICATION

CROSS-REFERENCE TO RELATED APPLICATION

This application is a Continuation application of U.S. application Ser. No. 12/170,737 filed on Jul. 10, 2008 now U.S. Pat. No. 7,962,051 and claims the benefit of Korean Patent Application No. 2008-2561, filed Jan. 9, 2008 in the Korean Intellectual Property Office, the disclosures of which are incorporated herein by reference.

BACKGROUND OF THE INVENTION

1. Field of the Invention

Aspects of the present invention relate to an image forming apparatus, and more particularly, to an image forming apparatus that authenticates a toner cartridge to prevent an unauthorized use of the toner cartridge.

2. Description of the Related Art

Generally, an image forming apparatus (such as a printer, a scanner, a facsimile machine, a copy machine, and a multifunction peripheral) has a print function that uses a plurality of consumables (such as a toner cartridge). Each of the consumables needs to be replaced after being used for a certain period of time due to a limited life span thereof depending on the amount used.

Typically, a customer replacement unit memory (CRUM), which is a semiconductor memory, is mounted on a consumable in order to achieve an enhancement in picture quality or a desired management for the life span of the consumable. Using the toner cartridge as an example, the serial number of the cartridge, the cartridge supplier, the residual amount of toner, and the state of toner are stored in the CRUM.

As the number of sheets of print media printed in accordance with a print operation increases, the amount of toner consumed increases. As a result, the amount of toner remaining in the toner cartridge varies. Accordingly, a controller executes operations to read the information stored in the CRUM and to store, in the CRUM, information as to the residual amount of toner varied in accordance with a print operation.

Generally, conventional image forming apparatuses use a detachable toner cartridge. For this reason, unauthorized damage to the information of the CRUM attached to the toner cartridge may easily occur. As a result, wrong uses of the toner cartridge are possible. For example, it may be possible to fill poor-quality toner in a consumed toner cartridge in order to further use the toner cartridge for print operations. Due to such an unauthorized use, a degradation in printing quality and a failure of the corresponding image forming apparatus may result. Furthermore, there is a problem in that the reliability of the information stored in the CRUM is degraded.

SUMMARY OF THE INVENTION

Aspects of the present invention provide an image forming apparatus that authenticates a toner cartridge to prevent an unauthorized use of the toner cartridge.

According to an aspect of the present invention, there is provided an image forming apparatus including: a toner cartridge including a memory to provide first authentication information, and an authentication key circuit to provide second authentication information; and a controller (such as a central processing unit) to determine whether the first authentication information and the second authentication information are identical, and to authenticate the toner cartridge when the first authentication information and the second authentication information are identical.

In an aspect of the invention, the toner cartridge may further include a cartridge frame and a cover, such that cartridge frame is bonded to the cover and the authentication key circuit is provided at a bonding surface of the cartridge frame.

In an aspect of the invention, the authentication key circuit may include a plurality of output terminals to provide the second authentication information, and a plurality of electric wires respectively connected to the plurality of output terminals.

In an aspect of the invention, the plurality of output terminals may respectively apply authentication key signals to the controller as the second authentication information, and each of the authentication key signals may have a level corresponding to whether a respective one of the electric wires is connected to a supply voltage source.

In an aspect of the invention, the controller may intentionally destroy the first authentication information or the second authentication information to prevent an unauthorized use of the toner cartridge in a state in which a toner contained in the toner cartridge has been completely consumed.

In an aspect of the invention, the image forming apparatus may further include a voltage varying unit to supply at least two voltages having different levels to the toner cartridge.

In an aspect of the invention, the voltage varying unit may supply, to the toner cartridge, a first voltage when in an authentication information destruction mode, and a second voltage, less than the first voltage, when in a normal mode.

In an aspect of the invention, the voltage varying unit may include a plurality of switches operating under a control of the controller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a table for explaining a case in which bit information output from the authentication key circuit is identical to authentication information stored in a customer replacement unit memory (CRUM) according to an embodiment of the present invention.

DETAILED DESCRIPTION OF THE EMBODIMENTS

Figure 1:
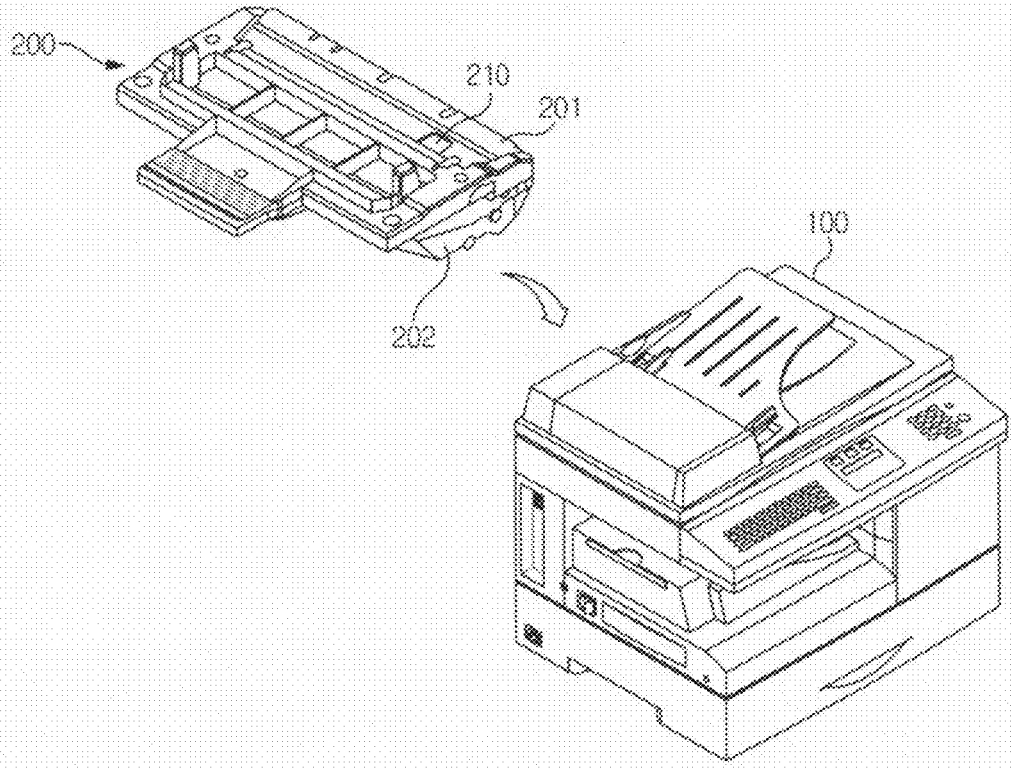
FIG. 1 is a perspective view illustrating an image forming apparatus and a toner cartridge to be mounted to a body of the image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a perspective view illustrating an image forming apparatus 100 and a toner cartridge 200 to be mounted to a body of the image forming apparatus according to an embodiment of the present invention. Referring to FIG. 1, the toner cartridge 200, which is consumable, is detachably mounted to the body of the image forming apparatus 100. The toner cartridge 200 includes a cartridge frame 202 to contain a toner, and a cover 201 to cover the cartridge frame 202. A customer replacement unit memory (CRUM) 210 is mounted on the cover 201.

Once the toner cartridge 200 is attached to the body of the image forming apparatus 100, the CRUM 210 comes into contact with contacts (not shown) arranged on the apparatus 100 body. Accordingly, the CRUM 210 can communicate with a controller (such as a central processing unit (CPU)) of the image forming apparatus 100 via the contacts. It is understood that according to other aspects, the CRUM 210 can connect to the controller via one or more wired connections or interfaces between the CRUM 210 and the contacts. Furthermore, it is understood that the CRUM 210 can also be mounted inside the frame 202 of the toner cartridge 200.

Figure 2:
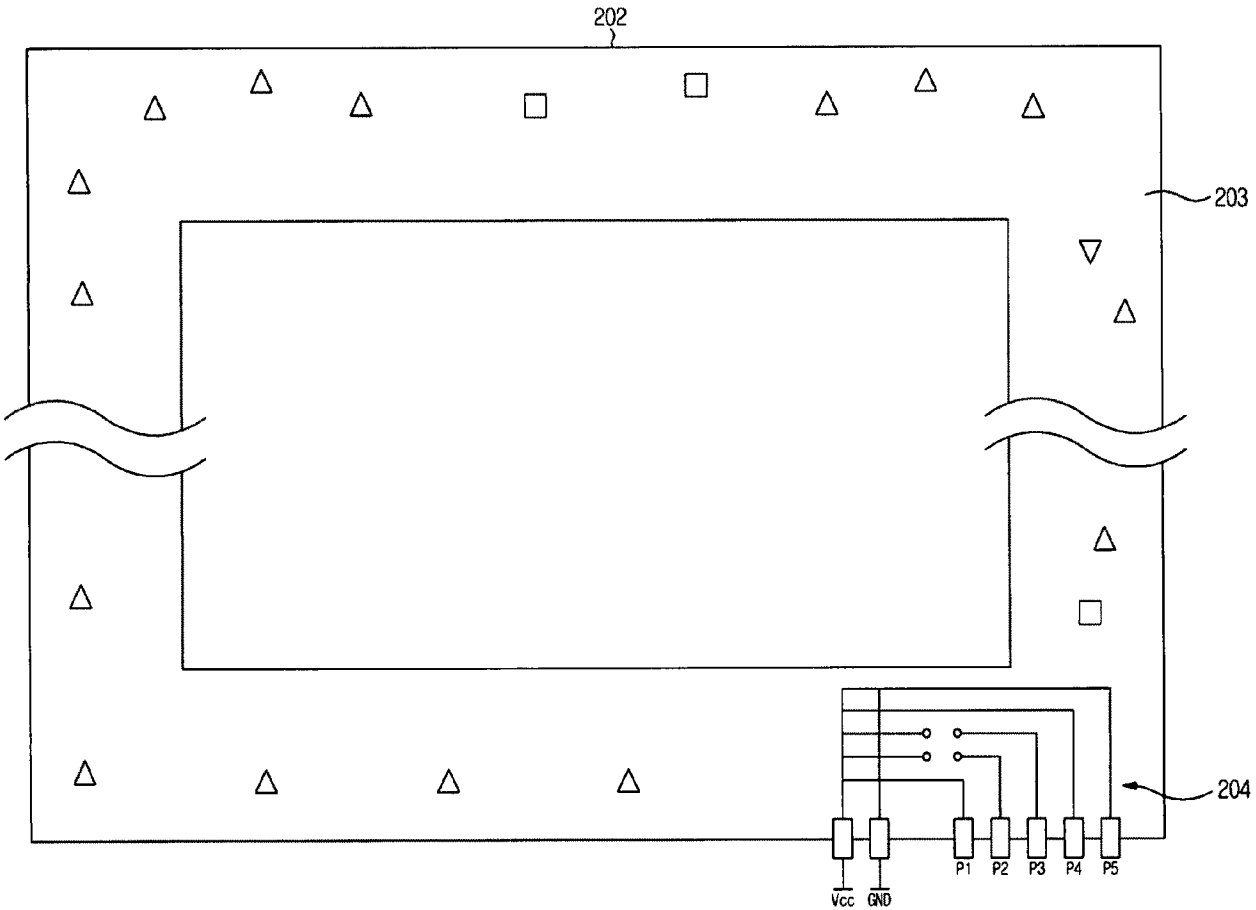
FIG. 2 is a schematic view for explaining an authentication key circuit formed at a bonding surface of a lower case included in the toner cartridge according to an embodiment of the present invention.

FIG. 2 is a schematic view for explaining an authentication key circuit 204 formed at a bonding surface of a lower case included in the toner cartridge according to an embodiment of the present invention. Referring to FIG. 2, where the toner cartridge 200 is manufactured such that the cover 201 is bonded to the frame 202 to form an integrated structure, the authentication key circuit 204 is provided in a certain portion of a bonding surface 203 of the cartridge frame 202. An insulating member may be provided at the bonding surface 203 on which the authentication key circuit 204 is arranged in order to provide an electrical insulation of the authentication key circuit 204. Alternatively, the bonding surface 203 may be made of an insulating material in other aspects.

The authentication key circuit 204 includes a plurality of output terminals P1, P2, P3, P4, and P5 to output a plurality of authentication key signals, respectively. The authentication key circuit 204 also includes a terminal to receive a supply voltage Vcc having a certain voltage level. The output terminals P1, P2, P3, P4, and P5 output different authentication key signals in accordance with a connection or a disconnection thereof to the supply voltage Vcc, respectively.

In the illustrated case, some of the output terminals P1, P2, P3, P4, and P5, (namely, the output terminals P1, P4, and P5) are electrically connected to the supply voltage Vcc, whereas the remaining output terminals P2 and P3 are cut off from the supply voltage Vcc. Accordingly, as the authentication key signals output from the output terminals P1, P4, and P5 electrically connected to the supply voltage Vcc have a level different from that of the output terminals P2 and P3 cut off from the supply voltage Vcc, authentication information of, for example, <1, 0, 0, 1, 1>, may be provided by the output terminals P1, P2, P3, P4, and P5.

When the authentication information received by the CPU is different from the above-described authentication information, the CPU recognizes that the authentication key circuit is in a damaged state due to damage to the toner cartridge, or recognizes that the authentication key is in an intentionally-destroyed state to prevent unauthorized filling of a toner in the toner cartridge, which may no longer contain a best quality of toner in accordance with the consumption of the toner.

The levels and output order of the authentication key signals output from the output terminals P1, P2, P3, P4, and P5 may be set by the manufacturer of the toner cartridge. For example, the levels and output order may correspond to the serial number of the toner cartridge. Also, the number of the output terminals may be more or less than the five illustrated in FIG. 2.

Figure 3:
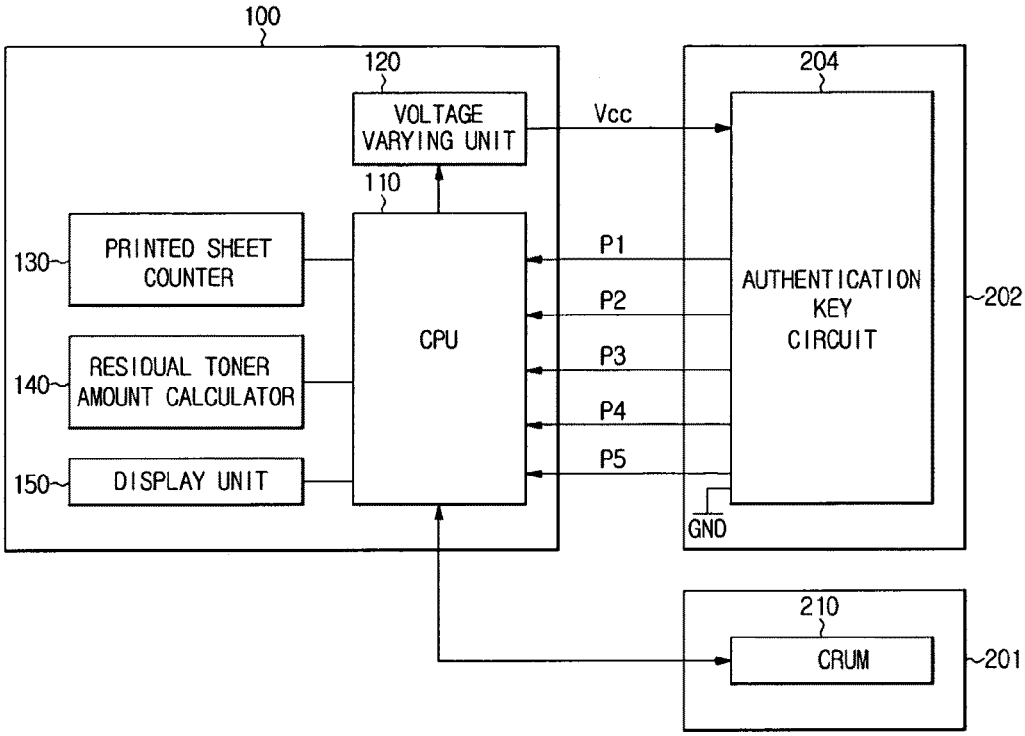
FIG. 3 is a block diagram of the image forming apparatus according to an embodiment of the present invention.

FIG. 3 is a block diagram of the image forming apparatus 100 according to an embodiment of the present invention. Referring to FIG. 3, the image forming apparatus 100 is electrically connected to the cover 201 and cartridge frame 202 of the toner cartridge 200. In addition to the CPU 110, the image forming apparatus 100 includes a voltage varying unit 120, a printed sheet counter 130, a residual toner amount calculator 140, and a display unit 150.

The printed sheet counter 130 counts the number of printed sheets of print media, and sends the counted value to the CPU 110. The residual toner amount calculator 140 calculates the residual amount of toner, based on the counted printed sheet number, and sends the calculated value to the CPU 110. The CPU 110 stores, in the CRUM 210 provided on the cover 201, the information regarding the counted printed sheet number and the calculated residual toner amount, and periodically updates the stored information. The voltage varying unit 120 supplies the supply voltage Vcc, which has a predetermined voltage level, to the authentication key circuit 204 according to an operation mode. The voltage varying unit 120 can vary the level of the supply voltage Vcc under the control of the CPU 110. For example, the CPU 110 controls the voltage varying unit 120 to supply, as the supply voltage Vcc, a low-level voltage in a normal mode, and a high-level voltage in a high-voltage application mode in which the authentication key is intentionally destroyed to prevent unauthorized use of the toner cartridge in a completely-consumed state of toner.

The CPU 110 receives authentication key signals respectively output from the output terminals P1, P2, P3, P4, and P5 of the authentication key circuit 204 provided in the cartridge frame 202. Thereafter, the CPU 110 compares authentication information corresponding to the level of the authentication key signal from each output terminal with the corresponding authentication information stored in the CRUM 210. The authentication information stored in the CRUM 210 by the manufacturer of the toner cartridge in association with each authentication key signal corresponds to a connection or a disconnection between the associated output terminal of the authentication key circuit 204 and the supply voltage Vcc.

When the authentication information corresponding to the levels of the authentication key signals is identical to the authentication information read from the CRUM 210, the CPU 110 allows a desired print operation to be executed. That is, when the authentication information output from the authentication key circuit 204 is identical to the authentication information stored in the CRUM 210, as shown in FIG. 4, the CPU 110 recognizes that a toner cartridge having a best quality (i.e., an authenticated toner cartridge) is in use. In this case, the CPU 110 allows the execution of a desired print operation. In contrast, when the output authentication information is different from the stored authentication information, the CPU 110 prevents the execution of a print operation.

Figure 5:
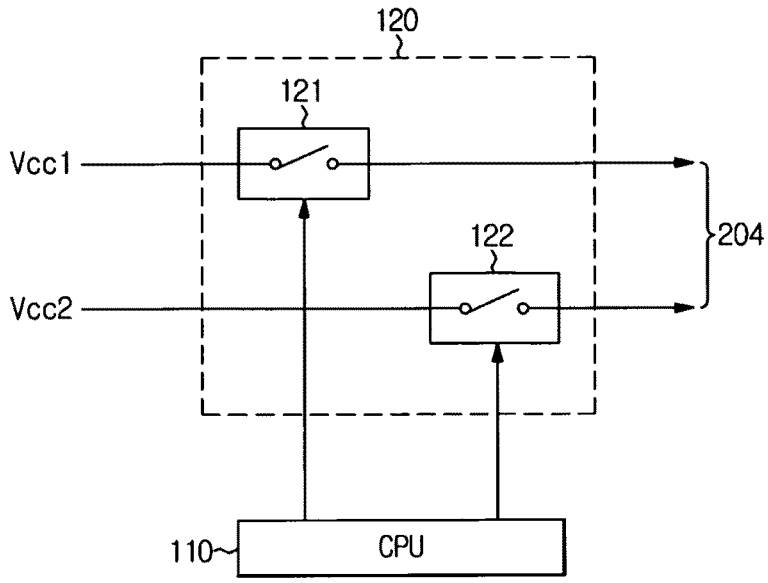
FIG. 5 is a circuit diagram illustrating a voltage varying unit according to an embodiment of the present invention.

As described above, the voltage varying unit 120 varies the level of the voltage supplied to the authentication key circuit 204 under the control of the CPU 110. FIG. 5 is a circuit diagram illustrating the voltage varying unit 120 according to an embodiment of the present invention. Referring to FIG. 5, the voltage varying unit 120 includes a first switch 121 and a second switch 122. The first switch 121 applies a low-level voltage Vcc1 to the authentication key circuit 204. The second switch 122 applies a high-level voltage Vcc2 to the authentication key circuit 204. The level of the high-level voltage Vcc2 is set so as to be capable of breaking electric wires respectively connected to the output terminals. The first and second switches 121 and 122 are alternately turned on/off in such a manner that, when one of the first and second switches 121 and 122 is in an ON state, the other of the first and second switches 121 and 122 is in an OFF state. When the high-level voltage Vcc2 is applied to the authentication key circuit 204, all electrical wires connected to the high-level voltage Vcc2 are broken. As a result, the authentication information respectively corresponding to the levels of the authentication key signals output from the output terminals P1, P2, P3, P4, and P5 are the same. For example, authentication information of <0, 0, 0, 0, 0> is provided. Meanwhile, the image forming apparatus 100 also includes a voltage supply circuit to supply voltages having different levels to various electric elements included in the image forming apparatus 100. This voltage supply circuit supplies both the low-level voltage Vcc1 and the high-level voltage Vcc2 to the authentication key circuit 204.

Figure 6:
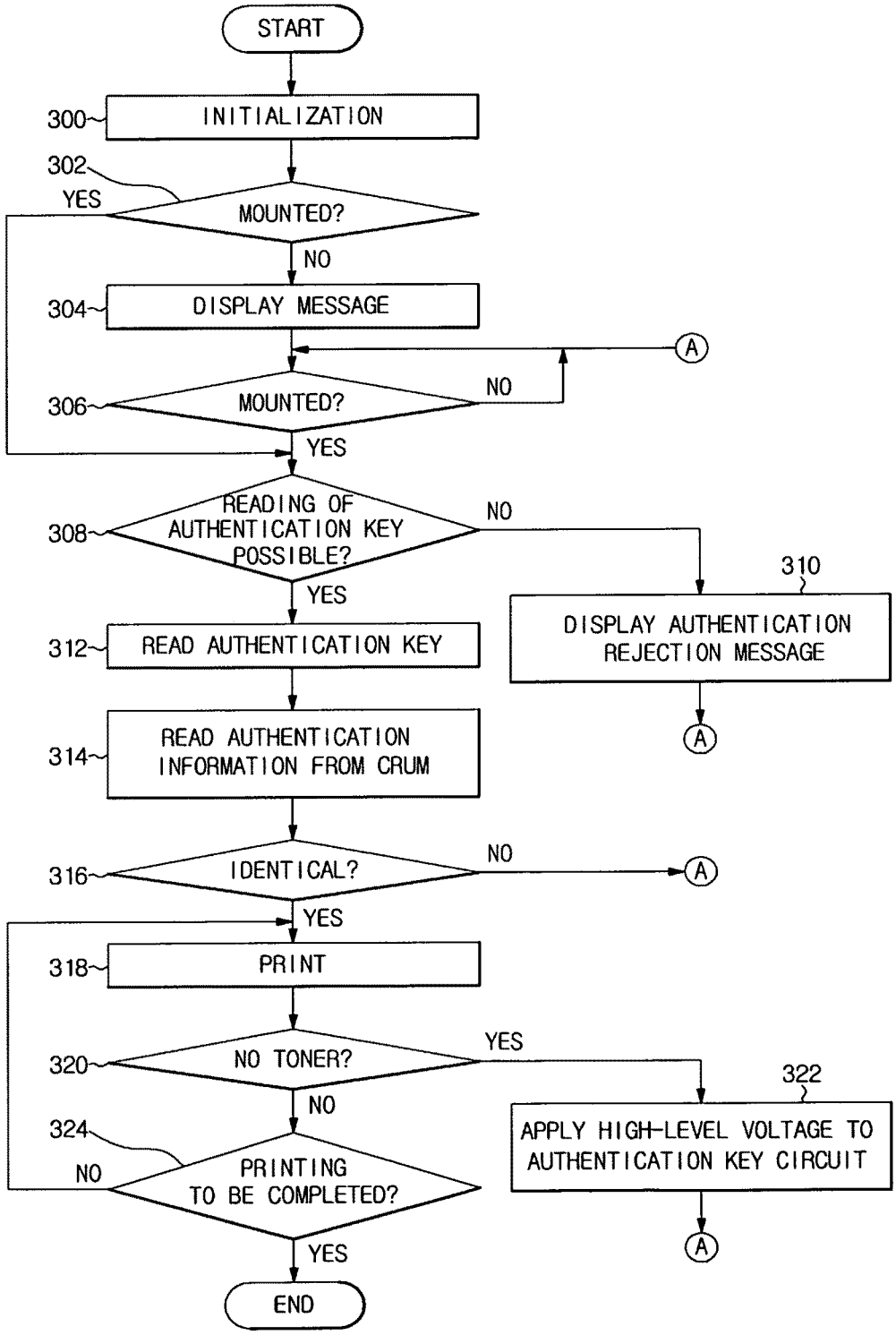
FIG. 6 is a flow chart explaining a method of controlling the image forming apparatus according to an embodiment of the present invention.

Hereinafter, a method of controlling the image forming apparatus according to aspects of the present invention will be described. FIG. 6 is a flow chart explaining a method of controlling the image forming apparatus according to an embodiment of the present invention. Referring to FIG. 6, when power is supplied to the image forming apparatus 100, an initialization is executed in operation 300. For example with reference to FIG. 5, during the initialization (operation 300), the CPU 110 turns on the first switch 121, while turning off the second switch 122. As a result, the voltage varying unit 120 supplies the low-level voltage Vcc1 to the authentication key circuit 204.

The CPU 110 then determines whether a toner cartridge 200 is attached to the image forming apparatus 100 in operation 302. For example, the attached state of the toner cartridge 200 may be determined according to an operating state of a mechanical switch (not shown). When it is determined that the toner cartridge 200 is not in an attached state (operation 302), the CPU 110 displays a message through the display unit 150 to inform the user of the non-attachment of the toner cartridge 200 in operation 304. Thereafter, the CPU 110 repeatedly determines whether the toner cartridge 200 is in a attached state in operation 306.

When it is determined that the toner cartridge 200 is in the attached state (operations 302 or 306), the CPU 110 determines whether the CPU 110 can read an authentication key from the authentication key circuit 204 provided on the bonding surface 203 of the cartridge frame 202. That is, the CPU 110 determines whether there is an authentication key signal input from the authentication key circuit 204 in operation 308.

When it is determined that it is not possible to read any authentication key (operation 308), the CPU 110 displays an authentication rejection message through the display unit 150 in operation 310. On the other hand, when it is determined that it is possible to read an authentication key (operation 308), the CPU 110 recognizes authentication information corresponding to the signal levels of the read authentication key in operation 312. Subsequently, the CPU 110 reads the authentication information stored in the CRUM 210 in operation 314, and then determines whether the read authentication information is identical to the authentication information corresponding to the authentication key in operation 316. When it is determined that the compared authentication information are different from each other (operation 316), the CPU 110 returns to operation 306. On the other hand, when it is determined that the compared authentication information are identical to each other (operation 316), the CPU 110 executes a print operation of an image on a print medium in operation 318.

Thereafter, the CPU 110 determines whether there is any residual toner based on the residual amount of toner calculated by the residual toner amount calculator 140 in operation 320. When it is determined that there is no residual toner left (operation 320), the CPU 110 controls to make the authentication key circuit 204 inoperable in operation 322. For example with reference to FIG. 5, the CPU turns off the first switch 121 while turning on the second switch 122. As a result, the voltage varying unit 120 supplies the high-level voltage Vcc2 to the authentication key circuit 204. As a result of the high-level voltage Vcc2, all electric wires connected to the output terminals P1, P2, P3, P4, and P5 are damaged in operation 322. The CPU 110 then returns to operation 306, to execute the above-described operations. Meanwhile, in the damaged state of the electric wires, the levels of the authentication key signals output from the output terminals are the same, so that the resultant authentication information is different from the authentication information stored in the CRUM 210. As a result, an authentication failure occurs. Accordingly, it is possible to prevent the toner cartridge 200 from being used by an unauthorized person or in an unauthorized manner.

When it is determined that there is a residual toner left (operation 320), the CPU 110 determines whether the print operation should be completed in operation 324. When it is determined that the print operation is not to be continued (operation 324), the CPU 110 returns to operation 318. On the other hand, when the print operation should be completed (operation 324), the CPU 110 completes the printing operation.

As is apparent from the above description, aspects of the present invention can prevent an unauthorized use of a toner cartridge 200 by enabling a print operation when compared authentication information are identical to each other, while preventing the print operation when the compared authentication information are different from each other. Moreover, when it is desired to reuse the toner cartridge 200, the manufacturer of the toner cartridge 200 newly sets the authentication information of an authentication key circuit built 204 in the cartridge frame 202, and stores, in the CRUM 210, authentication information corresponding to the newly-set authentication information. In this case, the user can reuse the toner cartridge in an authorized state.

Aspects of the present invention can also be embodied as computer-readable codes on a computer-readable recording medium. Also, codes and code segments to accomplish the present invention can be easily construed by programmers skilled in the art to which the present invention pertains. The computer-readable recording medium is any data storage device that can store data which can be thereafter read by a computer system or computer code processing apparatus. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Aspects of the present invention may also be realized as a data signal embodied in a carrier wave and comprising a program readable by a computer and transmittable over the Internet.

Although a few embodiments of the present invention have been shown and described, it would be appreciated by those skilled in the art that changes may be made in this embodiment without departing from the principles and spirit of the invention, the scope of which is defined in the appended claims and their equivalents.

What is claimed is:

1. An image forming apparatus comprising:

a central processing unit (CPU) provided on a body of the image forming apparatus;

a toner cartridge which is detachably provided on the body of the image forming apparatus and comprises an authentication key circuit, which has a plurality of output terminals to output authentication information and a plurality of electric wires connecting the output terminals to the CPU; and a voltage varying unit to supply a predetermined voltage to the authentication key circuit in order to destroy the authentication information upon an unauthorized use of the toner cartridge, wherein the authentication key circuit is provided on a flat bonding surface, and wherein at least one of the plurality of electric wires not being electrically connected to the supplied predetermined voltage.

2. The image forming apparatus as claimed in claim 1, wherein the providing the authentication key circuit on the flat bonding surface is one of either forming, printing, or tracing the authentication key circuit on the flat bonding surface.

3. The image forming apparatus as claimed in claim 1, wherein:

the plurality of output terminals respectively output authentication key signals as the authentication information; and each of the authentication key signals has a level corresponding to whether a respective one of the electric wires is connected to a supply voltage source.

4. The image forming apparatus as claimed in claim 3, wherein the voltage varying unit supplies a first voltage to the authentication key circuit in order to destroy second authentication information by destroying the plurality of electric wires when in an unauthorized use prevention mode, and supplies a second voltage less than the first voltage to the authentication key circuit in order for the plurality of output terminals to respectively apply the authentication key signals when in a normal operation mode.

5. The image forming apparatus as claimed in claim 4, wherein the voltage varying unit comprises a plurality of switches to switch the first and second voltages respectively supplied to the authentication key circuit when in an unauthorized use prevention mode and when in a normal operation mode.

6. An image forming apparatus comprising:

a central processing unit (CPU) provided on a body of the image forming apparatus;

a toner cartridge which is detachably provided on the body of the image forming apparatus and comprises an authentication key circuit, which has a plurality of output terminals to output authentication information and a plurality of electric wires connecting the output terminals to the CPU; and a voltage varying unit to supply a predetermined voltage to the authentication key circuit in order to destroy the authentication information upon an unauthorized use of the toner cartridge, wherein:

the authentication key circuit is provided on a flat bonding surface;

the toner cartridge further comprises a cartridge frame and a cover; and the cartridge frame is bonded to the cover, and the authentication key circuit is provided on a flat bonding surface that is a bonding surface of the cartridge frame.

7. An image forming apparatus comprising:

a central processing unit (CPU) provided on a body of the image forming apparatus;

a toner cartridge which is detachably provided on the body of the image forming apparatus and comprises an authentication key circuit, which has a plurality of output terminals to receive a voltage and to output authentication information and a plurality of electric wires connecting the plurality of output terminals to the CPU;

a supply voltage source to supply, to the authentication key circuit, a voltage to destroy the plurality of electric wires; and a switch to perform a switching operation to allow the voltage, which destroys the plurality of electric wires, to be supplied to the authentication key circuit in order to prevent the authentication information from being output upon an unauthorized use of the toner cartridge, wherein the authentication key circuit is provided on a flat bonding surface, and wherein at least one of the plurality of electric wires not being electrically connected to the supplied predetermined voltage.

8. The image forming apparatus as claimed in claim 7, wherein the providing the authentication key circuit on the flat bonding surface is one of either forming, printing, or tracing the authentication key circuit on the flat bonding surface.

9. An authentication key circuit for an image forming apparatus comprising:

a surface capable of bonding to a surface of a toner cartridge; and an input terminal for receiving a voltage to destroy authentication information upon an unauthorized use of the toner cartridge, wherein the authentication key circuit comprised of a plurality of electric wires is provided in a flat bonding surface, and wherein at least one of the plurality of electric wires not being electrically connected to a supplied predetermined voltage.

10. The authentication key circuit as claimed in claim 9, wherein the providing the authentication key circuit on the flat bonding surface is one of either forming, printing, or tracing the authentication key circuit on the flat bonding surface.

* * * * *